US006422305B2

(12) United States Patent
Jainek

(10) Patent No.: US 6,422,305 B2
(45) Date of Patent: Jul. 23, 2002

(54) LIQUID COOLING SYSTEM

(75) Inventor: Herbert Jainek, Heilbronn (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/780,609

(22) Filed: Feb. 12, 2001

(30) Foreign Application Priority Data

Feb. 10, 2000 (DE) ..... 100 05 889

(51) Int. Cl.[7] ..... F28F 3/08

(52) U.S. Cl. ..... 165/167; 165/916; 123/196 AB; 210/184

(58) Field of Search ..... 165/916, 167, 165/51; 123/196 AB, 41.33; 184/104.1, 104.2, 104.3; 210/184, 186

(56) References Cited

U.S. PATENT DOCUMENTS 4,580,625 A * 4/1986 Yamanaka et al. ..... 165/916
4,892,136 A * 1/1990 Ichihara et al. ..... 165/51
5,014,775 A * 5/1991 Watanabe ..... 165/167
5,511,612 A * 4/1996 Tajima et al. ..... 165/167
5,590,709 A * 1/1997 Tajima et al. ..... 165/916
5,787,977 A * 8/1998 Yuasa et al. ..... 165/167
5,797,450 A * 8/1998 Kawabe et al. ..... 165/167
5,927,394 A * 7/1999 Mendler et al. ..... 165/166
6,085,832 A * 7/2000 Rehberg ..... 165/167

* cited by examiner

*Primary Examiner*—Henry Bennett
*Assistant Examiner*—Terrell McKinnon
(74) *Attorney, Agent, or Firm*—Crowell & Moring LLP

(57) ABSTRACT

A liquid cooling system 10 for cooling liquids including a housing 11, a housing cover 12, and a liquid cooler 13. The housing 11 is sealingly fastened to the housing cover 12. The liquid cooler 13 is composed of cooling plates 19 stacked one on another. The cooling plates 19 sealingly separate a liquid space 20 from a coolant space 21. The coolant spaces 21 are connected by openings 26 which are disposed on projections 27 on the plates 19. In the housing 11 there is a liquid inlet 15, a liquid outlet 16, a coolant inlet 17 and a coolant outlet 18. The liquid inlet 15 leads into a housing volume 14 on an uncooled side 31 which is formed by the housing 11 and the liquid cooler 13. The uncooled side 31 lies opposite a cooled side 32 which communicates with a return passage 22 extending through the liquid cooler 13. The liquid inlet 15 is sealingly separated by a seal arrangement 25 from the coolant inlet 17 and coolant outlet 18.

11 Claims, 3 Drawing Sheets

LIQUID COOLING SYSTEM

BACKGROUND OF THE INVENTION

The present invention relates to a liquid cooling system, especially one which is suitable for cooling the lubricating oil of an internal combustion engine.

German Patent Application No. DE 296 22 191 discloses a plate-type heat exchanger which is comprised of a plurality of heat exchanger plates. The heat exchanger plates are formed by stacked deep-drawn troughs each having a circumferential marginal rim. The flow troughs have extensions on which surfaces of adjacent troughs are sealingly supported. In the area of temporary extensions which connect the troughs alternately to one another, openings are formed fore the heat-exchanging media. Turbulence vanes are placed in the troughs in contact on both sides with the stacked heat exchanger plates through tabs which are disposed in mutually offset rows, formed between parallel slots, and bent out of the plane of the plates in an undulating manner. The heat exchanger plates have openings associated with one another in pairs for the heat-exchanging media. The openings are arranged such that they are situated in the area of the extensions. Since the openings are smaller than the extensions, a sealing separation of the heat-exchanging media from one another is achieved.

By arranging the openings for the passage of the medium to be cooled and the openings for the cooling medium in the plates of the cooler, the effective heat exchange area of the plate heat exchanger is reduced. In order, however, to achieve good efficiency in the plate heat exchanger, the size of the plate heat exchanger is increased, so that it becomes bulkier. Since the openings must not have less than a minimum diameter for Theological reasons, the arrangement of the openings in the plates of the cooler determines the minimum size of the plate heat exchanger.

It is known that cooling elements can be built into a housing, and that connections for the coolant must be separate from the connections of the medium to be cooled, so as to cause no mixing of the two media with one another. For this purpose the connections of the two media are spatially separated and displaced from each other, and usually are contained in different components. In other embodiments of connections, the connections are passed through the housing and affixed with nuts.

These designs, however, are complicated to assemble, since the connections must be individually attached and connected. Furthermore, additional lines are needed, which require space and are considerably difficult to assemble. Despite the efforts of the prior art, there has remained a need for a liquid cooling system which requires little space and which can be assembled quickly and easily.

SUMMARY OF THE INVENTION

It is therefore the object of the invention to provide a liquid cooling system which is compact and requires little space for installation.

It is also an object of the invention to provide a liquid cooling system which can be assembled easily and quickly.

These and other objects of the invention are achieved in accordance with the present invention by providing a liquid cooling system comprising a housing defining an interior volume, a housing cover for closing the housing, and a liquid cooler disposed in the interior volume; the housing having at least one inlet for liquid to be cooled opening into the housing interior volume, at least one outlet for cooled liquid, at least one coolant inlet, and at least one coolant outlet; the liquid cooler being comprised of stacked cooler plates each forming a liquid space and a coolant space sealingly separated from one another, a return passage for the cooled liquid arranged in the liquid cooler such that it passes through all cooling plates; each liquid space having an opening in fluid communication with the inlet for liquid to be cooled and another opening in fluid communication with the outlet for cooled liquid, and the coolant spaces being in fluid communication through respective openings in a bottom plate of the liquid cooler with the coolant inlet and with the coolant outlet; wherein the bottom plate of the liquid cooler sealingly contacts the housing such that an inner area space and an outer area space completely surrounding the inner area are formed between the bottom plate and the housing and are separated from the housing interior volume; the inner area space connecting the return passage to the outlet for cooled liquid, and the outer area space connecting the coolant spaces to the coolant inlet and to the coolant outlet.

The liquid cooling system of the invention is advantageously suitable for cooling liquids such as water, oil or gasoline, and at the same time it requires little space for installation. Furthermore, the liquid cooling system of the invention can be assembled easily and quickly. For this purpose the liquid cooling system has a housing comprising a housing volume. The housing has at least one liquid inlet, one liquid outlet, a coolant inlet and a coolant outlet. These inlets and outlets can have any desired shape, such as round, oval, kidney-shaped, square, rectangular or polygonal. Also, they can vary in shape between the inlet and outlet, as for example round to oval or angular to round. They are connected to the respective lines of the corresponding circuits. Liquids, such as oil or water, for example, can be used, optionally containing additives. The housing can be an independent component into which only components of the liquid cooling system are integrated, or it also can be formed by other components. In this regard, it is possible for the housing to be formed as part of some other component of an internal combustion engine. Another variant for the construction of the housing it to configure a liquid tank, especially an oil pan, such that the housing functions are fulfilled.

The liquid cooling system furthermore comprises a housing cover and a liquid cooler. The housing cover is designed so that it can be sealingly attached to the housing. For this purpose the cover can. be fastened to the housing, for example, with screws, clips, or a bayonet lock. The housing cover, however, can also contain a screw thread which is screwed into the housing. If the housing is formed of other components as described above, the cover is sealingly joined to that component. The liquid cooler is constructed as a cooling module and is formed by individual cooler plates which are stacked and sealingly joined to one another. For example, the cooler plates can be soldered or adhesively bonded to one another. A liquid space is sealingly separated from a coolant space by the assembled cooler plates. Since a plurality of cooler plates are stacked one on top of another, a coolant space and a liquid space alternate with one another. These spaces are sealingly separated from one another so that no mixing of the coolant from the coolant space with liquid from the liquid space can occur. Furthermore, the liquid space has openings which allow the liquid to flow into and out of the liquid space. These openings communicate with the liquid inlet and the liquid outlet, but no separate component is provided for connecting the openings with the inlets and outlets. The liquid cooling system has only one connection route from the liquid inlet to the openings and from the openings to the liquid outlet. This connection route is defined by components already present, such as the housing with the liquid cooler.

The coolant space has openings in a bottom plate, which communicate with the coolant inlet and the coolant outlet through an intermediate space. The intermediate space, which is formed by the housing and the bottom plate, is subdivided into an inner area and an outer area. The outer area completely surrounds the inner area. These areas are sealed from one another and from the housing volume, so that the coolant can pass only from the bottom plate into the coolant inlet and out of it and not mix with the liquid to be cooled. If desired, gaskets may be used. Appropriate means are provided to prevent the coolant from passing directly from the coolant inlet to the coolant outlet. This can be accomplished by a structural configuration of the housing or bottom plate.

In the liquid cooler there is a return passage through which conducts the cooled liquid to the liquid outlet. The return passage passes through each cooler plate and is configured so that no liquid can pass in or out in the area of the cooler plates. For this purpose the return passage can be constituted by a separate component which is inserted into the liquid cooler or it can form a continuous, sealed duct through an appropriate configuration of the cooler plates, into which neither the uncooled liquid nor the coolant can enter. This return passage opens into an inner area adjoining the liquid outlet.

One advantageous embodiment of the invention envisions the use of sealing rings, such as O-rings, for example, to seal the inner area from the outer area. Furthermore, sealing rings can be used for sealing the outer area from the housing volume. The sealing rings can be composed of synthetic resin materials, especially elastomers. However, sealing rings of soft metals can also be used. These sealing rings are placed in recesses in the housing or bottom plate, and after the liquid cooler is installed in the housing, they seal the different areas from one another. For this purpose 2 seals are to be provided for the separation of 3 sides.

One particular embodiment of the invention involves the use of a nipple for fastening the liquid cooler in the housing. For this purpose the nipple is inserted into the liquid outlet and can be affixed with a snap fastening, for example. The nipple can be fixedly attached to the liquid cooler, especially by soldering. The connection between the nipple and the liquid cooler can be made at the bottom plate. Alternatively, however, the nipple can also be extended centrally through the liquid cooler and rest against a cover plate, with the liquid cooler clamped between the nipple and the housing. A fixed connection of the nipple inserted into the liquid cooler can likewise be provided.

An advantageous embodiment of the invention envisions a thread on the nipple, by which the nipple can be screwed into the liquid outlet and thus provide a connection to the housing. For this purpose the counter thread is to be provided in the housing, especially in the liquid outlet. The thread of the nipple can also be a self-cutting thread, so that no thread needs to be provided in the liquid outlet. With this way of fastening the liquid cooler in the housing, an optimum sealing of the return passage to the liquid outlet is achieved, and with the central application of force by the threaded nipple, an optimum sealing of the inner and outer areas is assured.

It is advantageous to provide ribs in the housing to form flow channels for the media passed through the liquid cooler. These ribs are distributed about the circumference and produce a resistance to flow by which the media follow their course through the liquid cooler. A certain bypass leakage of the liquid between the housing and the liquid cooler, which can be defined according to the tolerances of the liquid cooler and the ribs, does not impair the cooling function.

An especially advantageous embodiment of the liquid cooling system is the combination of the liquid cooler with a filter element. With this design, connecting lines to carry the liquid from the liquid cooler into a filter can be omitted, as well as the filter housing and filter cover. The filter element separates the raw liquid side from the clean liquid side. The filter element is disposed, for example, on the cover plate, with a filter element receptacle being provided to receive the filter element and seal the raw liquid side from the clean liquid side. In this embodiment of the liquid cooler, the housing cover is joined not to the liquid cooler but to the filter element. The cooled and filtered liquid is conducted into the return passage and returned to the liquid circuit through the liquid outlet.

It is advantageous to configure the filter element as a replaceable cartridge so that the liquid cooler system can remain where it is installed, and the filter element can be replaced simply by removing the housing cover.

An advantageous embodiment of the liquid cooling system is to be seen in a cylindrical design. In this embodiment a good ratio of cooling surface and filter surface to the space occupied by the device is achieved.

According to another embodiment of the invention, a central tube is provided to support the filter element in a liquid cooling system having a cylindrical design. This central tube can have holes or slots so that the liquid can flow out through them. Also, the central tube can be formed on the housing cover and, by placing the housing cover on the housing it can be brought into an internal space formed by the filter element on the clean liquid side. This central tube furthermore has a sealing seat on which the filter element is supported and thus sealingly separates the clean liquid side from the raw liquid side. The central tube, however, can also be attached to the cover plate, so that the housing cover does not need to be inserted into the filter element during assembly. Instead, the filter element is simply placed on the central tube, and the housing cover is screwed onto the housing.

In this embodiment it is advantageous to provide a piston rod which extends through the filter element and the liquid cooler into the liquid outlet. This piston rod closes a liquid drain through which, when the piston rod is lifted, the liquid can be drained out without pressure (i.e, under the influence of gravity). When the housing cover is closed, the liquid cooling system is to be ready for operation. In this condition, therefore, the drain must be closed by the piston rod. After the housing cover is removed from the housing the liquid cooling system is no longer ready to operate, and the liquid contained in the filter element and return passage should drain away so that the filter element can be replaced, for example. In order that it will not be necessary to remove the piston rod from the liquid drain, the liquid cooler and the filter element, an axial stop is provided in the liquid outlet for the piston rod to strike against when the cover is removed. Also, the piston rod is releasably snapped into the housing cover. When the liquid cooling system is assembled, the piston rod is inserted into the liquid outlet, then the liquid cooler is screwed in place with the threaded nipple, so that the piston rod can no longer be removed from the liquid drain. After the filter element is inserted the housing cover is placed on the housing, causing the piston rod to engage in a socket provided for it. The piston rod is sealingly pressed against the liquid drain by the housing cover. When the housing cover is removed, a tension force acts on the piston rod which lifts the piston rod from the liquid drain, and then makes it possible for the liquid to drain out through the liquid outlet. To remove the housing cover completely in order to replace the filter element, for example, the piston rod is released from the socket. The socket can be, for example, a releasable catch which permits repeated attachment and release of the piston rod.

It is advantageous that fastening units are provided on the housing for affixing the liquid cooling system to an adjacent component. The fastening units, however, are necessary only when the housing is an independent component and is not formed, for example, by a component present in a vehicle. The fastening units can be in the form of bores through which screws are inserted and can be screwed into a supporting component. Other fastening units such as snap fasteners or clamping elements can likewise be provided.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
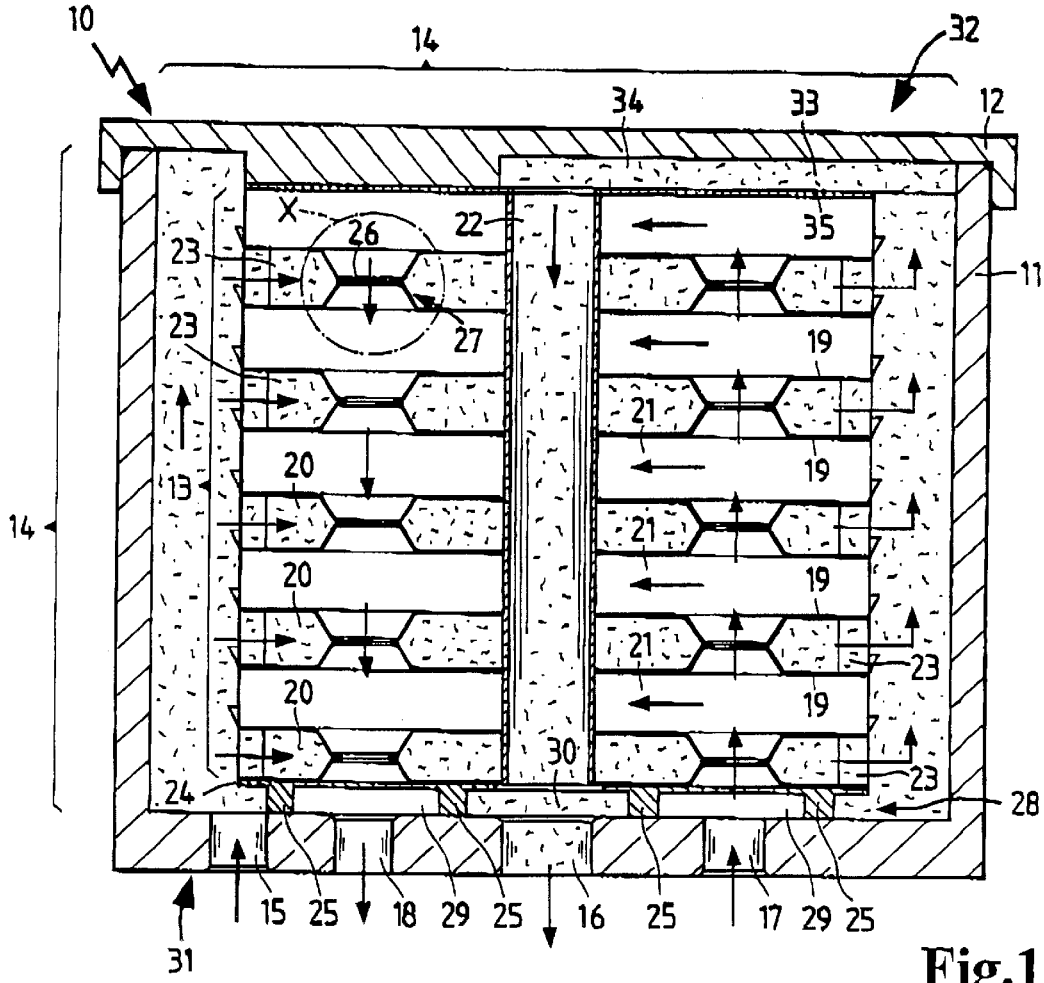
FIG. 1 shows a sectional view of a first liquid cooling system embodiment according to the invention.

FIG. 1 depicts a rectangular liquid cooling system 10 in a sectional view. It comprises a housing 11 of metal or plastic, a housing cover 12 also of metal or plastic, and a liquid cooler 13. The housing 11 encloses a housing volume 14 and has an inlet 15 for the liquid to be cooled and an outlet 16 for the cooled liquid. Furthermore, a coolant inlet 17 and coolant outlet 18 are situated in the housing 11. These inlets and outlets 15, 16, 17, 18 are all arranged in one plane. The liquid cooler 13 is constructed of individual cooler plates 19 which are joined together. Cooler plates 19 preferably are made of metal in order to create good heat exchange conditions. The cooler plates 19 are sealingly joined together, for example, by soldering, so that a liquid space 20 always alternates with a coolant space 21. To enable the cooled liquid to reach the outlet 16, a return passage 22 is provided in the liquid cooler 13. This return passage 22 passes through all of the cooler plates 19, but no leakage occurs between the liquid space 20 and the return passage 22 or between the coolant space 21 and the return passage 22. For this purpose the return. passage 22 is made as a separate component in this embodiment, and can be inserted into the liquid cooler 13 and joined sealingly to the cooler plates 19.

Every second cooler plate 19 has openings 23 through which the liquid can enter and leave the liquid cooler 13. The liquid cooler 13 has a bottom plate 24 which constitutes the lowermost cooler plate 19. This bottom plate 24 is sealingly joined to the housing 11. For this purpose bottom plate 24 has sealing projections 25 which sealingly engage against the housing 11. A intermediate space 28 is created by these sealing means 25 between the bottom plate 24 and the housing 11. The sealing means 25 divide the intermediate space 28 from the housing volume 14 into an inner area 30 and an outer area 29, with the outer area 29 completely surrounding the inner area 30. The liquid inlet 15 leads into the housing volume 14 and thus lies outside of the outer area 29. The coolant inlet 17 and outlet 18 lead into the outer area 29, so that the liquid being cooled is sealed off from the coolant. The return passage 22 leads into the inner area 30. The liquid being cooled flows through the inlet 15 into the housing volume 14 and enters through the openings 23 into the liquid space 20. In order that the flow will pass not just through the lowermost liquid space 20 alone, flow resisting means (not shown) are installed which can be designed according to the position of the liquid space 20. After the liquid has passed through the liquid space 20, it exits into the housing volume 14 through the oppositely arranged openings 23. In this case, however, no mixing of the cooled liquid with the uncooled liquid takes place. For this purpose the housing 11 can be configured so that the liquid cooler 13 divides the housing volume 14 into an uncooled end 31 and a cooled end 32. On the two sides of the rectangular liquid cooling system 10 the liquid cooler 13 lies against the housing 11. The liquid flows at the cooled end 32 through a gap 33, which is formed by a groove 34 and a cover plate 35, into the return passage 22. The groove 34 is made in the housing cover 12, for example by milling. The cover plate 35 is placed sealingly onto the topmost cooler plate 19, so that the coolant is sealed in the liquid cooler. In this embodiment, the housing cover 12 is pressed onto the housing 11. This pressing of the housing parts 11 and 12 are designed so as to offer sufficient resistance to the maximum permissible internal pressure.

Figure 2:
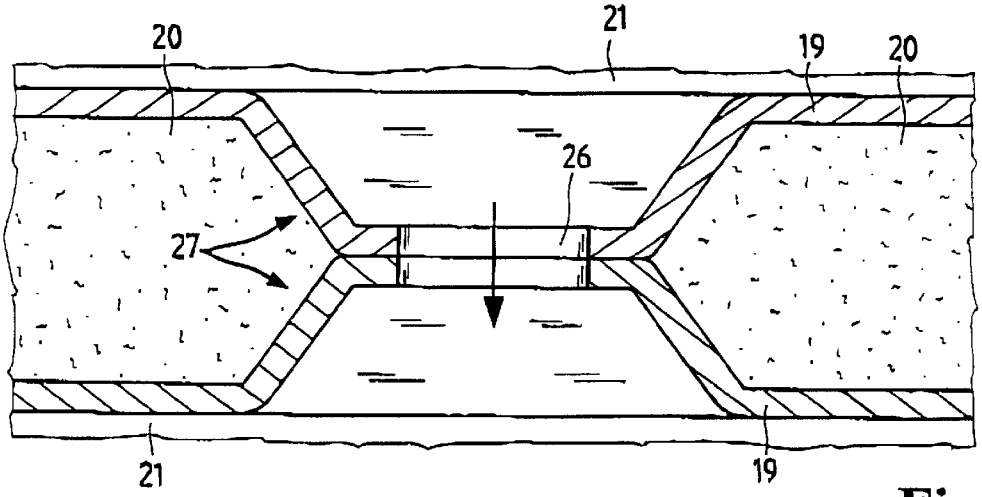
FIG. 2 shows an enlarged detail view X of FIG. 1.

FIG. 2 shows an enlarged detail X from FIG. 1. The cooler plates 19 have openings 26 through which the coolant can flow. The openings 26 are situated in projections or shoulders 27, the projection 27 of the first cooler plate 19 extending upward and the projection 27 of the second cooler plate 19 extending downward. These two projections 27 are joined sealingly together and the opening 26 is positioned within this sealed area. The projections 27 advantageously may have a frustoconical configuration.

Figure 3:
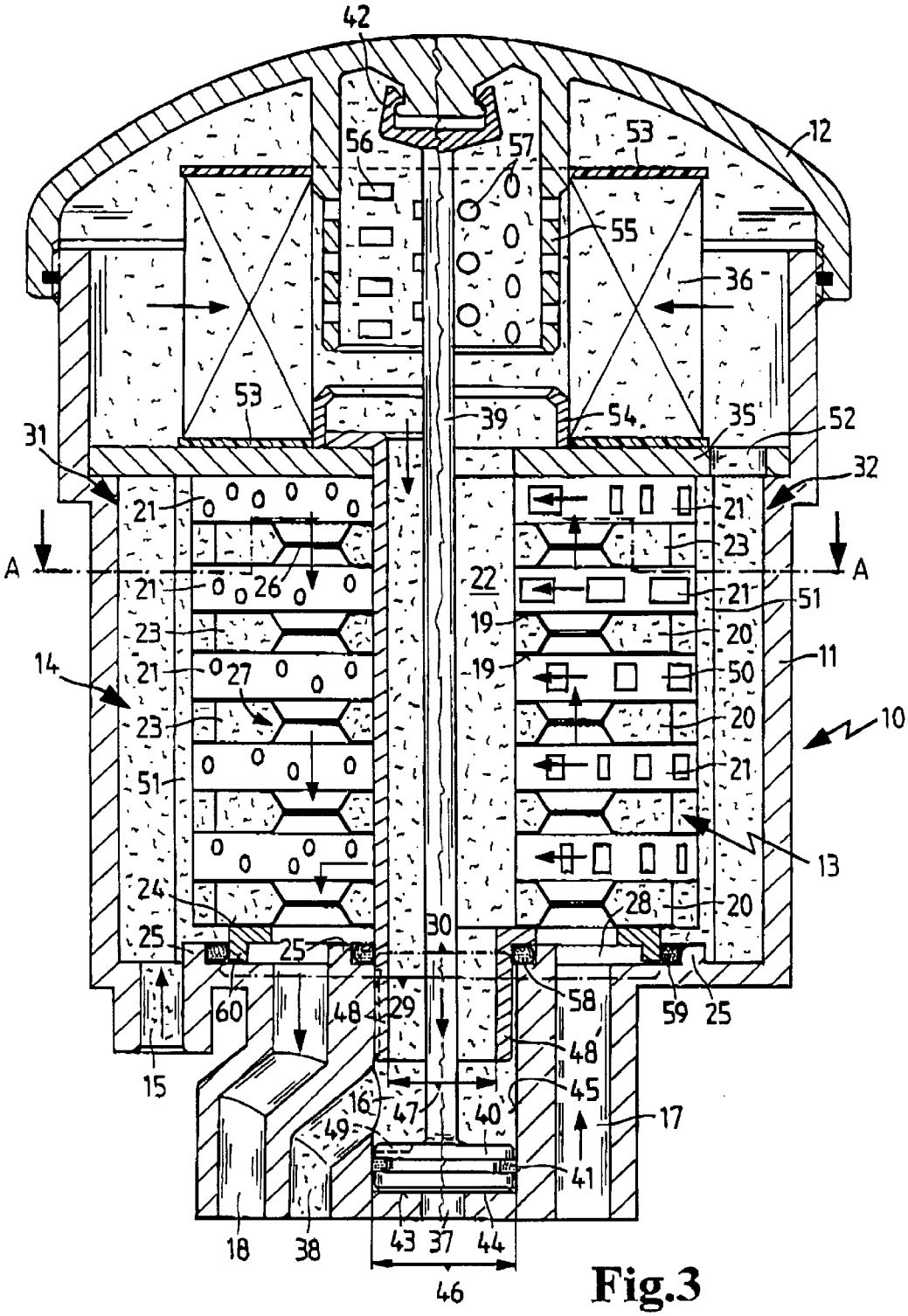
FIG. 3 shows a sectional view of two other liquid cooling system embodiments.

In FIG. 3 a cylindrical liquid cooling system 10 is illustrated in a sectional view, with the left and right halves of the figure showing different embodiments. It comprises a cylindrical housing 11, a housing cover 12 and a liquid cooler 13, with the housing cover 12 being screwed sealingly onto the housing 11. Integrated into this embodiment is a filter element 36 for filtering the cooled liquid. The housing 11 has a liquid inlet 15, a liquid outlet 16, a coolant inlet 17 and a coolant outlet 18. These inlets and outlets 15, 16, 17, 18, are arranged in one plane and are at least partially parallel to one another. The liquid outlet 16 is adjoined by a liquid drain 37, through which the liquid can drain out without pressure (i.e., solely under the influence of gravity). So that the liquid will flow, not into the liquid drain 37, but into a liquid line 38 likewise adjoining the liquid outlet 16, a piston rod 39 is provided, which has at one end a cylindrical piston 40 with a radial seal 41 and at the other end a snap fastener 42. An end face 43 of piston 40 makes contact with a liquid outlet bottom 44 and the radial gasket 41 lies sealingly around a liquid outlet wall 45. The piston 40 has an outside diameter 46 that is greater than an inside diameter 47 of a nipple 48 screwed into the liquid outlet 16. Thus the piston cannot be removed from the liquid outlet 16 when the cylindrical nipple 48 is screwed in. The snap fastener 42 of the piston rod 39 is releasably attached to the housing cover 12. As soon as the housing cover 12 is unscrewed from the housing 11, the piston 40 is drawn upward until it abuts against the nipple 48. Since the piston 40 cannot be drawn any further upward, the snap fastener 42 becomes released from the housing cover 12. Therefore the piston 40 can remain in the liquid outlet 16 and the housing cover 12 can be removed. To prevent the liquid from being blocked by the piston 40 in the liquid outlet 16, at least a single groove 49 is created in the piston 40 on a side opposite the end face 43. The liquid can then flow around through this groove 49 and reach the liquid drain 37. However, to assure the drainage of the liquid, the piston 40 can also have other forms, such as undulations, cones or spacers.

The liquid cooler 13 is formed by cooler plates 19 stacked one above another. The cooler plates 19 are joined sealingly together and thus alternatively define a liquid space 20 and a coolant space 21. The coolant spaces 21 are provided with openings 26 which are situated in projections 27 sealingly joined to one another. Around the openings 26 sufficient material is present to assure the tightness of the projections so that no coolant can enter the liquid space. The coolant passes through the openings 26 in the projections 27, from one coolant space 21 into the next higher coolant space 21. If the cooler plates 19 consist of a formable material such as sheet metal, the projections 27 can be formed on the cooler plates 19 by a stamping process. So that the coolant flows not only through the lowermost coolant space 21, baffle plates 50 are installed which interfere with the flow of the coolant and cause the coolant to reach the coolant spaces 21 at higher levels. Thus all of the coolant spaces 21 are uniformly cooled. The coolant passes out of the liquid cooler system 10 through the coolant outlet 18.

The liquid to be cooled is carried through the liquid inlet 15 into the liquid cooling system 10. The liquid inlet 15 in this embodiment is of a kidney shape. In other embodiments it can be round, oval or angular. The liquid is distributed in a housing volume 14 which is formed by the housing 11 and the liquid cooler 13. The housing volume 14 is divided into an uncooled side 31 and a cooled side 32. So that these two sides 31 and 32 do not communicate directly with one another, at least two ribs 51 are provided in the housing 11 and prevent direct flow from the uncooled side 31 to the cooled side 32. The cooling plates 19 have openings 23 which communicate with the liquid space 20. Each liquid space 20 has at least two openings 23. The liquid flows out of the housing volume 14 on the uncooled side 31 through a first opening 23 into the liquid space 20, and through a second opening 23 the liquid flows into the housing volume 14 on the cooled side 32. Since the liquid cooler 13 is inserted into the housing 11, some leakage may occur between the ribs 51 and the liquid cooler 13. This leakage, however, does not in any way interfere with the cooling operation, since the volume of the leakage is very small in comparison to the volume of the cooled liquid.

In this embodiment a filter element 36 is arranged following the liquid cooler 13. To prevent the liquid from reaching the filter element 36 in an uncontrolled manner, a cover plate 35 is provided which is joined sealingly to the housing 11 and allows the liquid to flow only through an angular or cylindrical, for example, bore 52 to the filter element 36. The filter element 36 has two end disks which sealingly adjoin the filter element 36. These end disks 53 are held against a sealing projection 54 which is placed on the cover plate 35 and against a central tube 55 which is formed on the housing cover. As shown on the left half of the figure, the central tube 55 can have slots 56 or, as shown on the right half, holes 57 through which the fluid passes into the return passage 22.

On the left half of the figure the liquid cooler 13 is screwed by means of a nipple 48 into the liquid outlet 16, the nipple 48 being inserted through the liquid cooler 13 and thus forming the return passage 22. The nipple 48 is in contact with an inner sealing ring 58 so that the coolant is sealingly separated from the cooled liquid. The nipple 48 furthermore serves to fix the liquid cooler in the housing 11, and the cover plate 35 can likewise be affixed by the nipple 48.

On the right half of the figure the sleeve 48' is arranged on the bottom plate 24 of the liquid cooler 13. The nipple 48' can be sealingly soldered, threaded or welded to the bottom plate 24. In this embodiment the nipple 48' likewise corresponds with an inner sealing ring 58 so as to assure separation of the cooled liquid from the coolant.

The inner sealing ring 58 can be placed against the sealing projection 25 which is formed on the housing 11. To seal the coolant from the uncooled liquid an outer sealing ring 59 is provided which bears against an outer sealing projection 25. To encase the outer sealing ring 59 an insert 60 can be provided which urges the outer sealing ring 59 against the outer sealing projection 25 and permits the liquid and the coolant to flow through.

Figure 4:
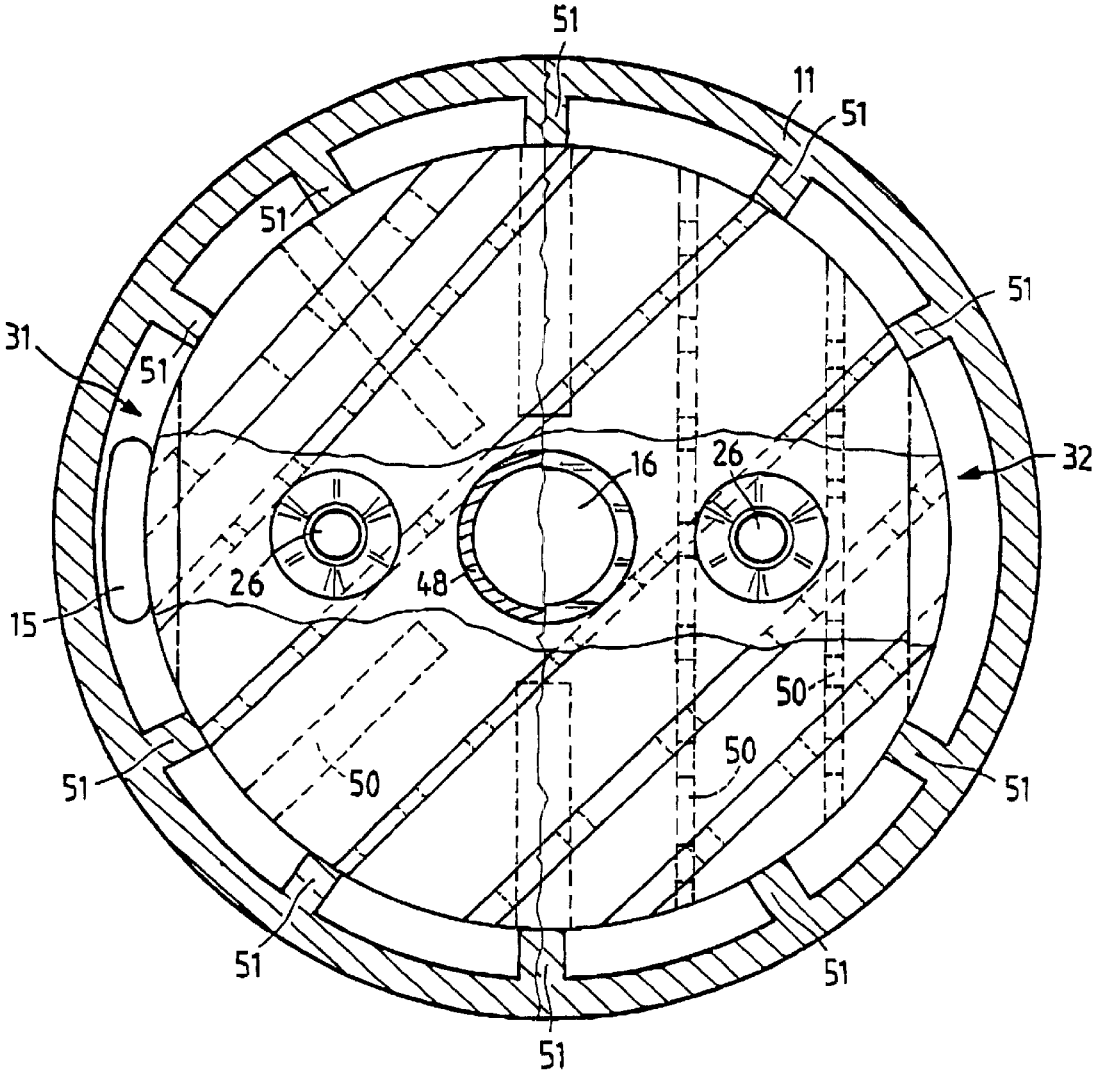
FIG. 4 shows a transverse sectional view taken along line A—A of FIG. 3.

In FIG. 4 the liquid cooling system 10 is shown in a sectional view taken along line A—A of FIG. 3. The section A—A runs partly through the coolant space 21 and partly through the liquid space 20. The cylindrical housing 11 has ribs 51 distributed on its circumference, which support the liquid cooler 13. The leakage that occurs between the ribs 51 and the liquid cooler 13 is negligible since it is very small in comparison to the entire throughput of the cooled liquid.

The liquid inlet 15 is kidney-shaped ,in the housing 11, and partially follows the contour of the liquid cooler 13. To augment the resistance to flow, the baffle plates 50 are arranged in the liquid space 20. These can be interrupted or continuous. The interrupted baffle plates 50 can be perforated or slotted and can extend through the entire liquid space or coolant space 20, 21. The continuous versions are shorter than the liquid space or coolant space, and so they are to be arranged such that the liquid or coolant cannot flow directly through, but must flow around them.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. A liquid cooling system comprising a housing defining an interior volume, a housing cover for closing the housing, and a liquid cooler disposed in said interior volume; said housing having at least one inlet for liquid to be cooled opening into the housing interior volume, at least one outlet for cooled liquid, at least one coolant inlet, and at least one coolant outlet; said liquid cooler being comprised of stacked cooler plates each forming a liquid space and a coolant space sealingly separated from one another, a return passage for the cooled liquid arranged in the liquid cooler such that it passes through all cooling plates; each liquid space having an opening in fluid communication with the inlet for liquid to be cooled and another opening in fluid communication with the outlet for cooled liquid, and the coolant spaces being in fluid communication through respective openings in a bottom plate of the liquid cooler with the coolant inlet and with the coolant outlet; wherein the bottom plate of the liquid cooler sealingly contacts the housing such that an inner area space and an outer area space completely surrounding the inner area are formed between the bottom plate and the housing and are separated from the housing interior volume; said inner area space connecting the return passage to the outlet for cooled liquid, and said outer area space connecting the coolant spaces to the coolant inlet and to the coolant outlet.

2. A liquid cooling system according to claim 1, further comprising sealing rings arranged between the liquid cooler and the housing to seal the inner and outer areas from each other and from the interior of the housing.

3. A liquid cooling system according to claim 1, wherein the liquid cooler is fixed in the housing by a nipple engaged in the liquid outlet.

4. A liquid cooling system according to claim 3, wherein the nipple has a screw thread which screws into the liquid outlet.

5. A liquid cooling system according to claim 4, wherein the screw thread is a self-tapping thread.

6. A liquid cooling system according to claim 1, further comprising ribs arranged in the housing between the housing and the liquid cooler to hinder the liquid from bypassing the liquid cooler.

7. A liquid cooling system according to claim 1, further comprising a filter element interposed in a liquid flow path through the liquid cooling system, said filter element sealingly separating a raw liquid space from a clean liquid space.

8. A liquid cooling system according to claim 7, wherein the filter element is a replaceable filter cartridge.

9. A liquid cooling system according to claim 1, wherein the liquid cooler has a cylindrical construction.

10. A liquid cooling system according to claim 7, further comprising a piston rod which extends through a central tube on which the filter element is mounted and through the liquid cooler to the liquid outlet, said piston rod opening and closing a drain adjacent the liquid outlet, and said piston rod being releasably attached to the housing cover, and said outlet comprising an axial abutment which retains the piston rod in the housing when the housing cover is removed.

11. A liquid cooling system according to claim 1, further comprising attachment members on said housing for attaching the liquid cooling system to an adjoining component.

* * * * *